US008328574B1

(12) United States Patent
Lin

(10) Patent No.: US 8,328,574 B1
(45) Date of Patent: Dec. 11, 2012

(54) CABLE CONNECTOR JOINT FASTENING STRUCTURE

(75) Inventor: Chih-Cheng Lin, Lujhu Township (TW)

(73) Assignee: Quantum Precision Technology Co., Ltd., Taoyuan County (TW)

( * ) Notice: Subject to any disclaimer, the term of this patent is extended or adjusted under 35 U.S.C. 154(b) by 0 days.

(21) Appl. No.: 13/209,429

(22) Filed: Aug. 14, 2011

(30) Foreign Application Priority Data

Jun. 14, 2011 (TW) ..... 100210764 U

(51) Int. Cl.
*H01R 4/38* (2006.01)

(52) U.S. Cl. ..... 439/321

(58) Field of Classification Search ..... 439/321, 439/318, 369, 359, 361, 372, 320, 314
See application file for complete search history.

(56) References Cited

U.S. PATENT DOCUMENTS 1,665,095 A * 4/1928 Henry ..... 439/372
6,554,626 B2 * 4/2003 Ramos, Jr. ..... 439/318
7,097,514 B2 * 8/2006 Ishizaki et al. ..... 439/681
7,186,130 B1 * 3/2007 Miller ..... 439/369
7,452,233 B1 * 11/2008 Michelsen ..... 439/369

FOREIGN PATENT DOCUMENTS

TW M391748 U 11/2010

* cited by examiner

*Primary Examiner* — Felix O Figueroa
(74) *Attorney, Agent, or Firm* — Chun-Ming Shih; HDLS IPR Services

(57) ABSTRACT

A cable connector joint fastening structure includes a male connector, a female connector, and a fastener. The male connector includes a male terminal body with a male terminal joint, a freely rotating screw sleeve locked around the external periphery of the male terminal joint. The female connector includes a female terminal body with a female terminal joint, and an insert space formed in the female terminal joint for inserting the male terminal joint, and the screw sleeve is screwed and coupled to the female terminal joint. The fastener includes a pivot portion formed at an external side of the female connector, and a locking arm pivotally installed onto the pivot portion, extended towards the male terminal body, disposed across the screw sleeve, and locked to the male connector.

10 Claims, 8 Drawing Sheets

CABLE CONNECTOR JOINT FASTENING STRUCTURE

FIELD OF THE INVENTION

The present invention relates to a connector, in particular to a cable connector joint fastening structure.

BACKGROUND OF THE INVENTION

In a conventional cable connector, male and female connectors are provided for achieving the effect of connecting the cable connector, and an enhanced connection structure is generally deigned for improving the insertability or connectivity of the connectors and assuring a secured connection of the male and female connectors to prevent them from being loosened or separated.

However, the enhanced connection structure of the conventional cable connector still has the drawbacks of being loosened easily or affecting the functions of present existing installed components, and thus its appearance and structure must be redesigned and such cable connector is not applicable for a particular model only. For example, a conductive terminal connecting device as disclosed in Taiwan Pat. No. M391748 includes a locking hook locked into a locking hole to achieve the effect of preventing the connecting device from being loosened, but this structure cannot be applied to a cable connector that requires further screwing after the cable connector is connected, or this structure fails to prevent the screwed cable connector from being loosened or separated. Obviously, the conventional cable connector requires improvements.

In view of the aforementioned drawbacks of the prior art, the inventor of the present invention based on years of experience in the related industry to conduct extensive researches and experiments, and finally provided a feasible solution and design in accordance with the present invention to overcome the drawbacks of the prior art.

SUMMARY OF THE INVENTION

Therefore, it is a primary objective of the present invention to provide a cable connector joint fastening structure, wherein male and female connectors of the connector are locked with one another, while a locking component is installed across a screw sleeve for screwing and connecting the male and female connectors and further limiting the rotation of the screw sleeve, so as to achieve the effects of preventing the male and female connectors from being loosened and complying with the related specifications and requirements.

To achieve the foregoing objectives, the present invention provides a cable connector joint fastening structure, comprising a male connector, a female connector, and at least one fastener, wherein the male connector includes a male terminal body, a male terminal joint formed on the male terminal body, and a freely rotating screw sleeve circularly locked onto an external periphery of the male terminal joint; the female connector includes a female terminal body, a female terminal joint formed on the female terminal body, and an insert space formed in the female terminal joint and provided for inserting the male terminal joint, and the screw sleeve being screwed and coupled to the female terminal joint; and the fastener includes a pivot portion disposed on an external side of the female connector and a locking arm pivotally installed onto the pivot portion, and the locking arm being extended towards the male terminal body, disposed across the screw sleeve, and locked with the male connector.

DESCRIPTION OF THE PREFERRED EMBODIMENTS

The technical characteristics and contents of the present invention will become apparent with the following detailed description and related drawings. The drawings are provided for the purpose of illustrating the present invention only, but not intended for limiting the scope of the invention.

Figure 1:
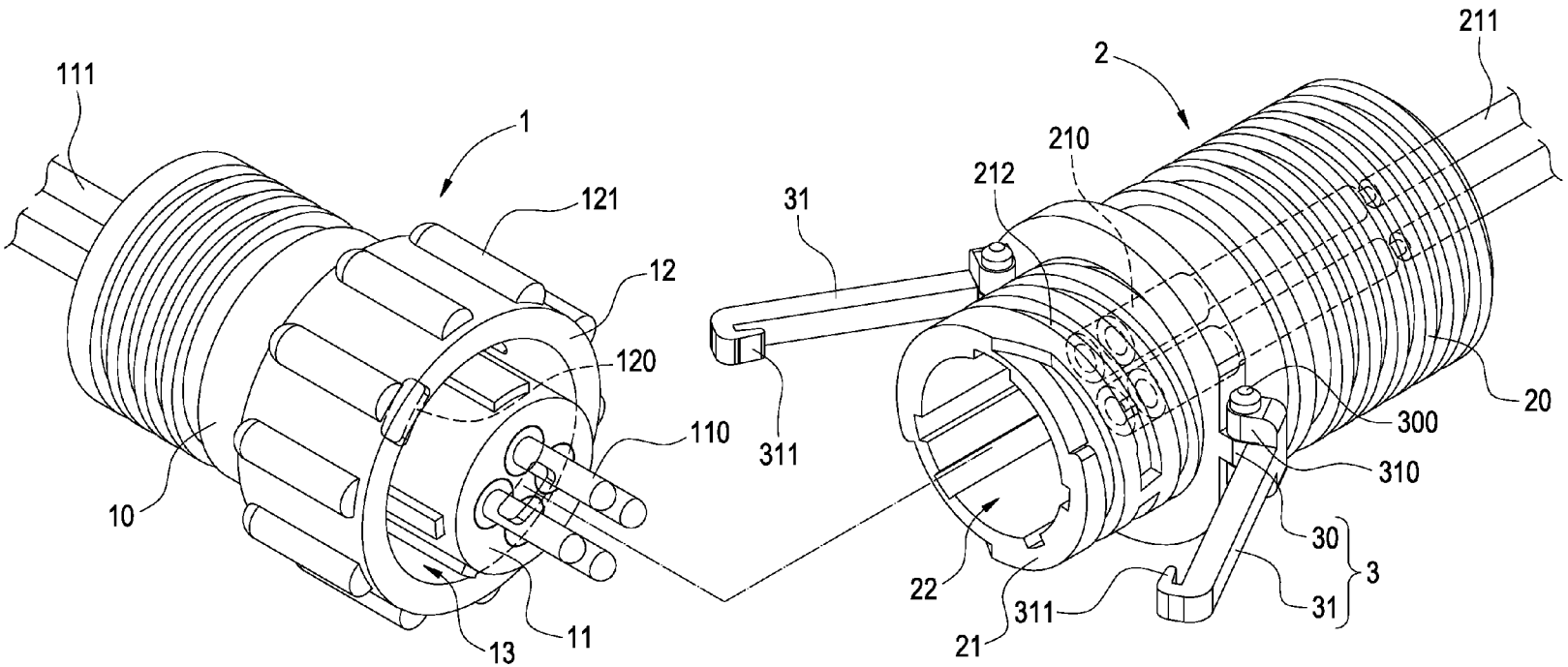
FIG. 1 is an exploded view of a first preferred embodiment of the present invention.
Figure 2:
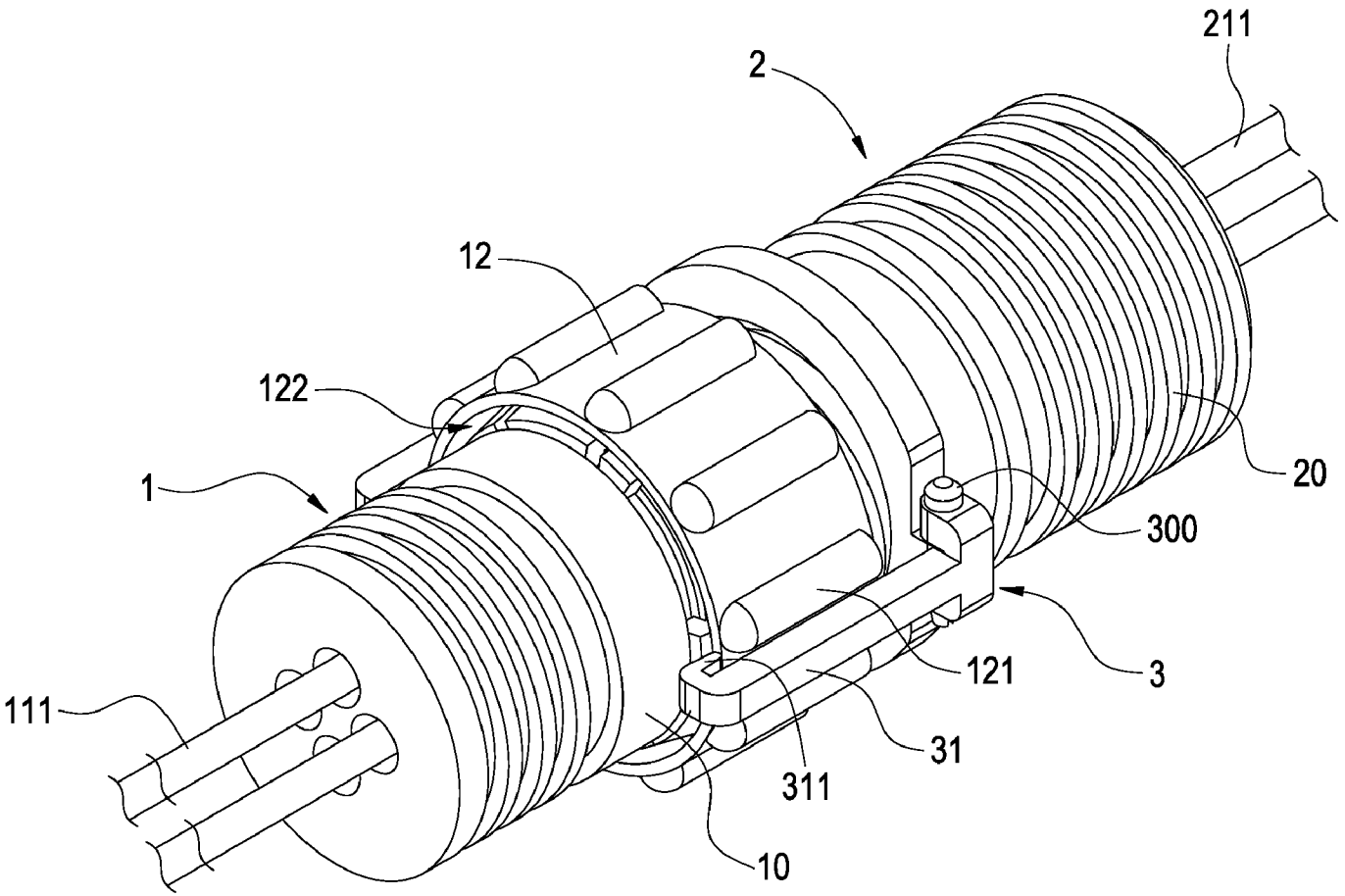
FIG. 2 is a perspective view of the first preferred embodiment of the present invention.

With reference to FIGS. 1 and 2 for an exploded view and a perspective view of a first preferred embodiment of the present invention respectively, the invention provides a cable connector joint fastening structure comprising a male connector 1, a female connector 2, and at least one fastener 3.

The male connector 1 includes a cylindrical male terminal body 10, a male terminal joint 11 protruded from a front end of the male terminal body 10, and a plurality of male terminals 110 disposed in the male terminal joint 11. Each male terminal 110 is extended to an end of the male terminal body 10 and electrically coupled to each wire core 111 in the cable (not shown in the figure). In this preferred embodiment of the present invention, each male terminal 110 is protruded from the front end of the male terminal joint 11. Further, the male terminal joint 11 includes a freely rotating screw sleeve 12 locked to the external periphery of the male terminal joint 11 and a screwing space 13 is formed between the screw sleeve 12 and the male terminal joint 11, and the screw sleeve 12 includes an internal screw portion 120 (such as internal thread) formed on an internal wall surface of the screw sleeve 12, and a plurality of pushing ribs 121 protruded from the external wall surface of the screw sleeve 12 for providing a friction to facilitate turning by a user's hand, wherein each pushing rib 121 is arranged in an axial direction and disposed apart from one another on the external wall surface of the screw sleeve 12.

The female connector 2 includes a cylindrical female terminal body 20, a female terminal joint 21 protruded from a front end of the female terminal body 20, and a hollow insert space 22 formed in the female terminal joint 21 for inserting the female terminal joint 21 when connecting to the male connector 1. In the meantime, the female terminal body 20 includes a plurality of corresponding female terminals 210 installed therein and coupled to the male terminals 110 respectively for the connection of the connector, and each female terminal 210 is extended to an end of the female terminal body 20 and electrically coupled to each wire core 211 of another cable (not shown in the figure). In this preferred embodiment of the present invention, each female terminal 210 is buried into the female terminal joint 21. Further, an external screw portion 212 (such as an external thread or a thread block as shown in the figure) is formed on an external wall surface of the female terminal joint 21. When the male terminal joint 11 is inserted into the insert space 22 of the female terminal joint 21, the female terminal joint 21 is situated precisely in the screwing space 13 between the screw sleeve 12 and the male terminal joint 11, such that the external screw portion 212 of the female terminal joint 21 and the internal screw portion 120 of the screw sleeve 12 are screwed and coupled to one another. More specifically, in the process of inserting the male terminal joint 11 into the of the insert space 22 of the female terminal joint 21, the screw sleeve 12 is rotated to connect the internal screw portion 120 with the external screw portion 212 of the female terminal joint 21, and the male terminal joint 11 is inserted into the insert space 22 to achieve the connection effect of the connector.

Figure 3:
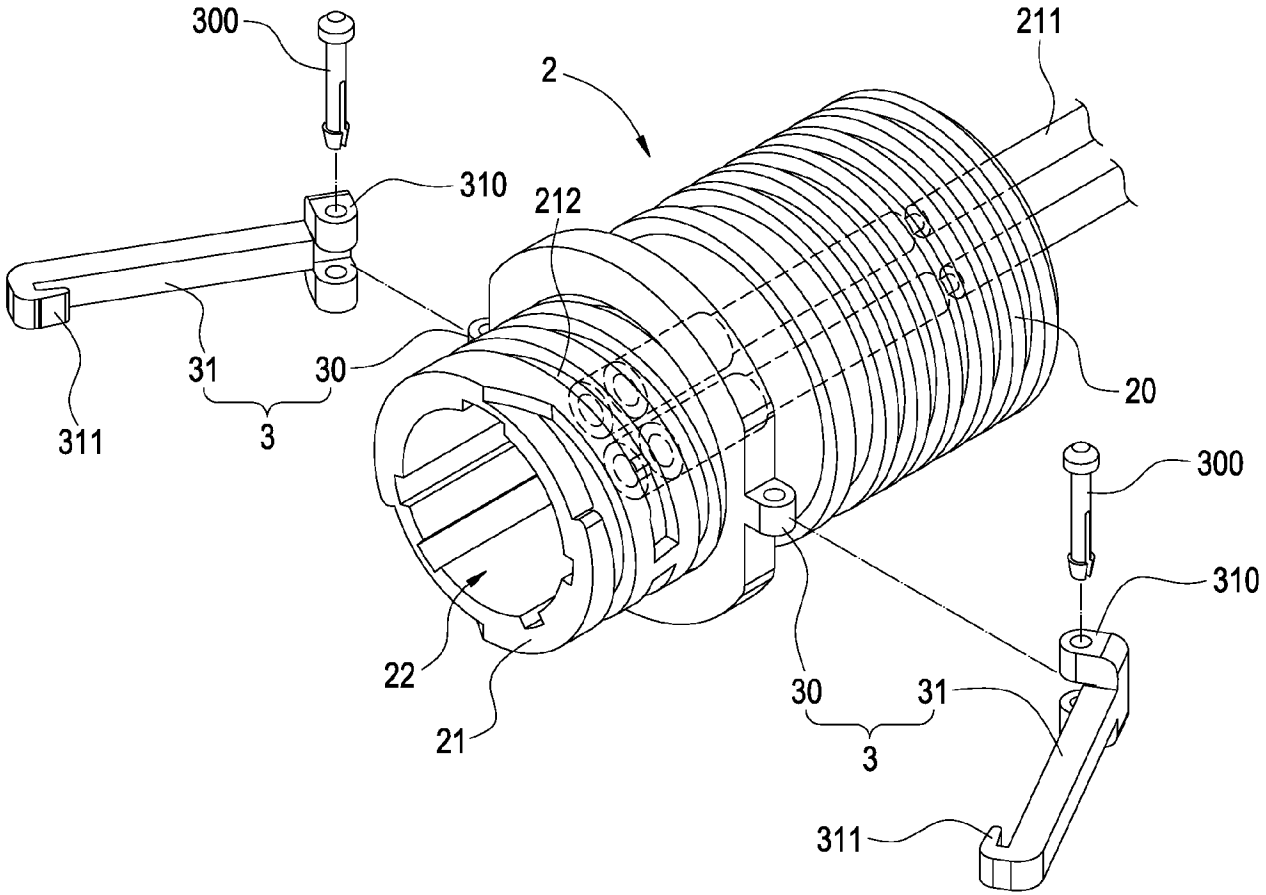
FIG. 3 is an exploded of a female connector in accordance with the first preferred embodiment of the present invention.
Figure 4:
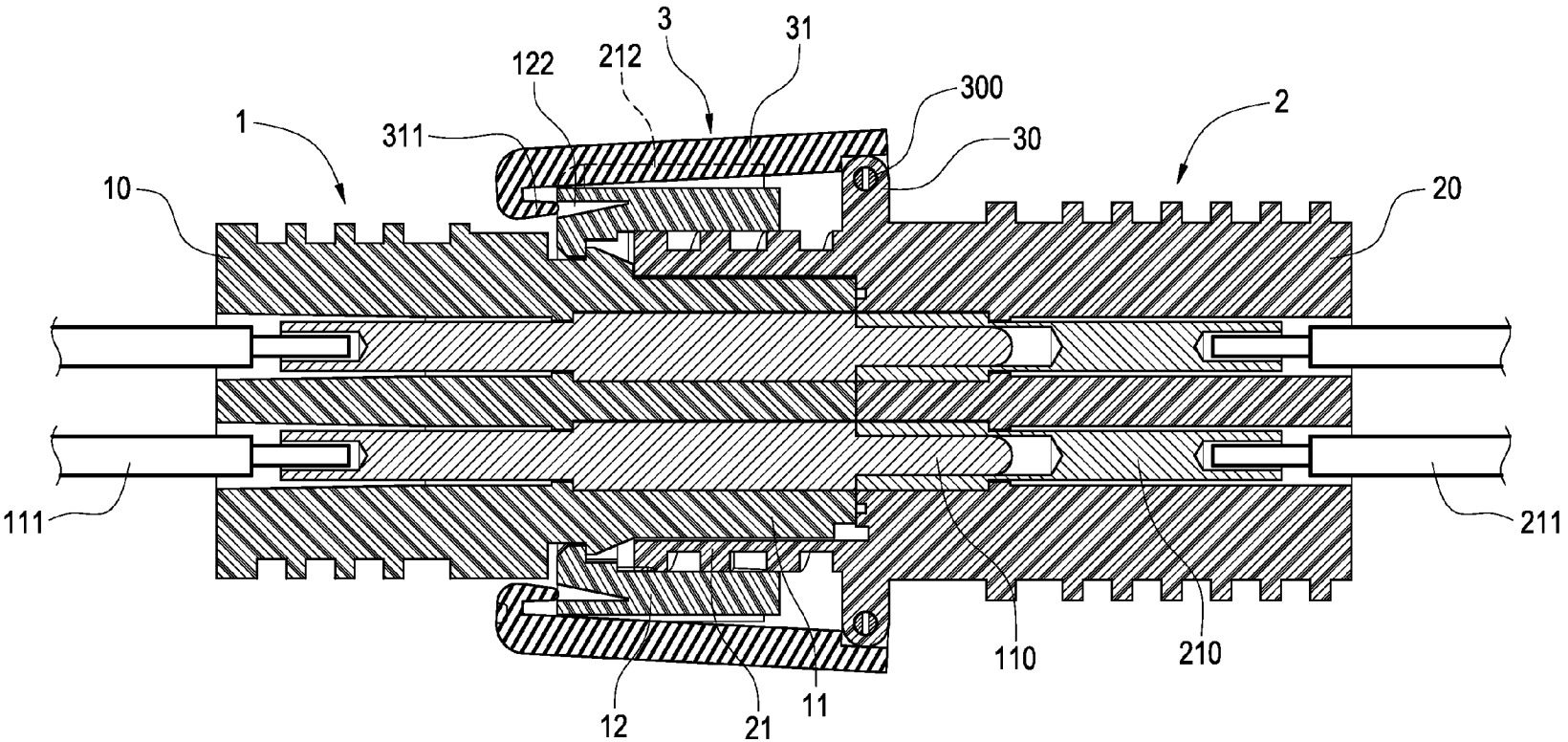
FIG. 4 is a cross-sectional view of the first preferred embodiment of the present invention.
Figure 5:
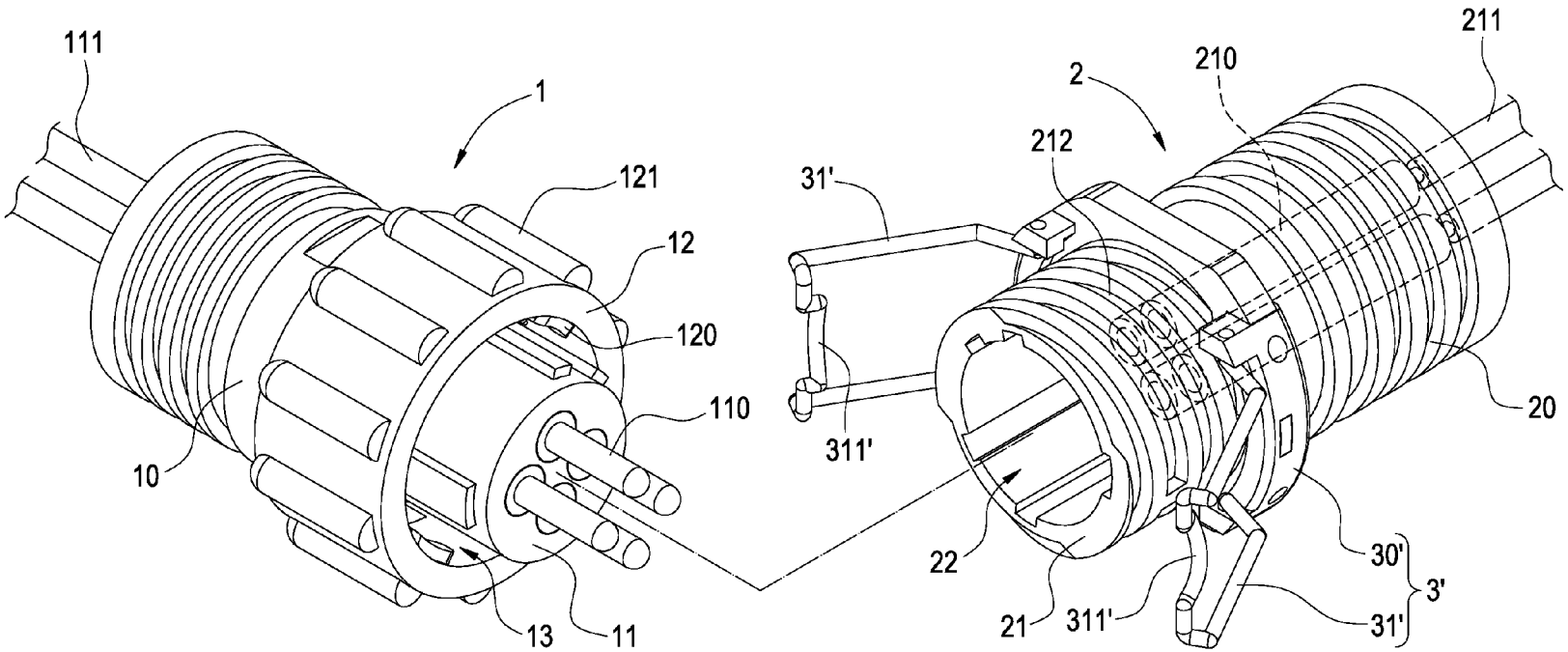
FIG. 5 is an exploded view of a second preferred embodiment of the present invention.
Figure 6:
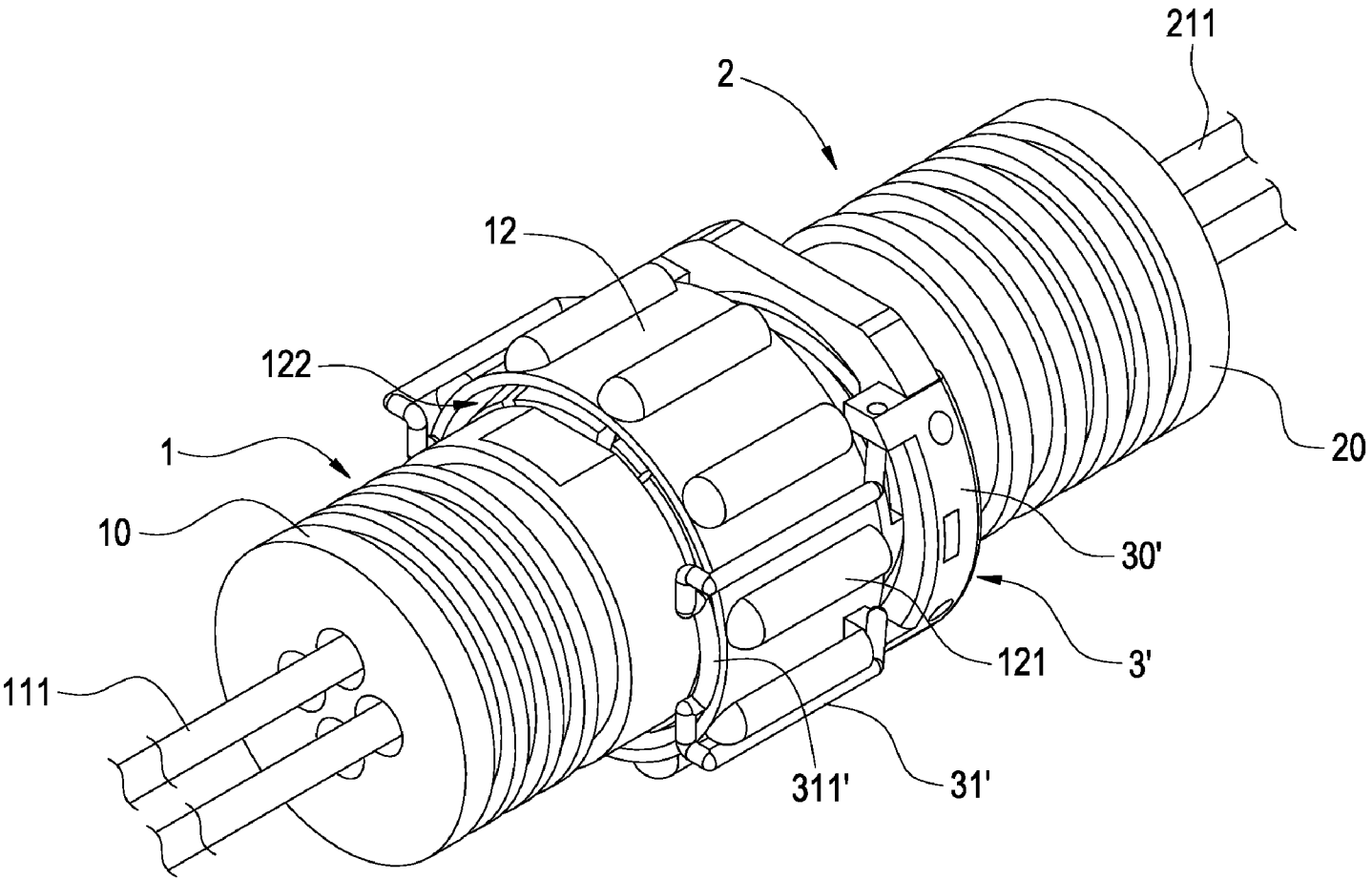
FIG. 6 is a perspective view of the second preferred embodiment of the present invention.
Figure 7:
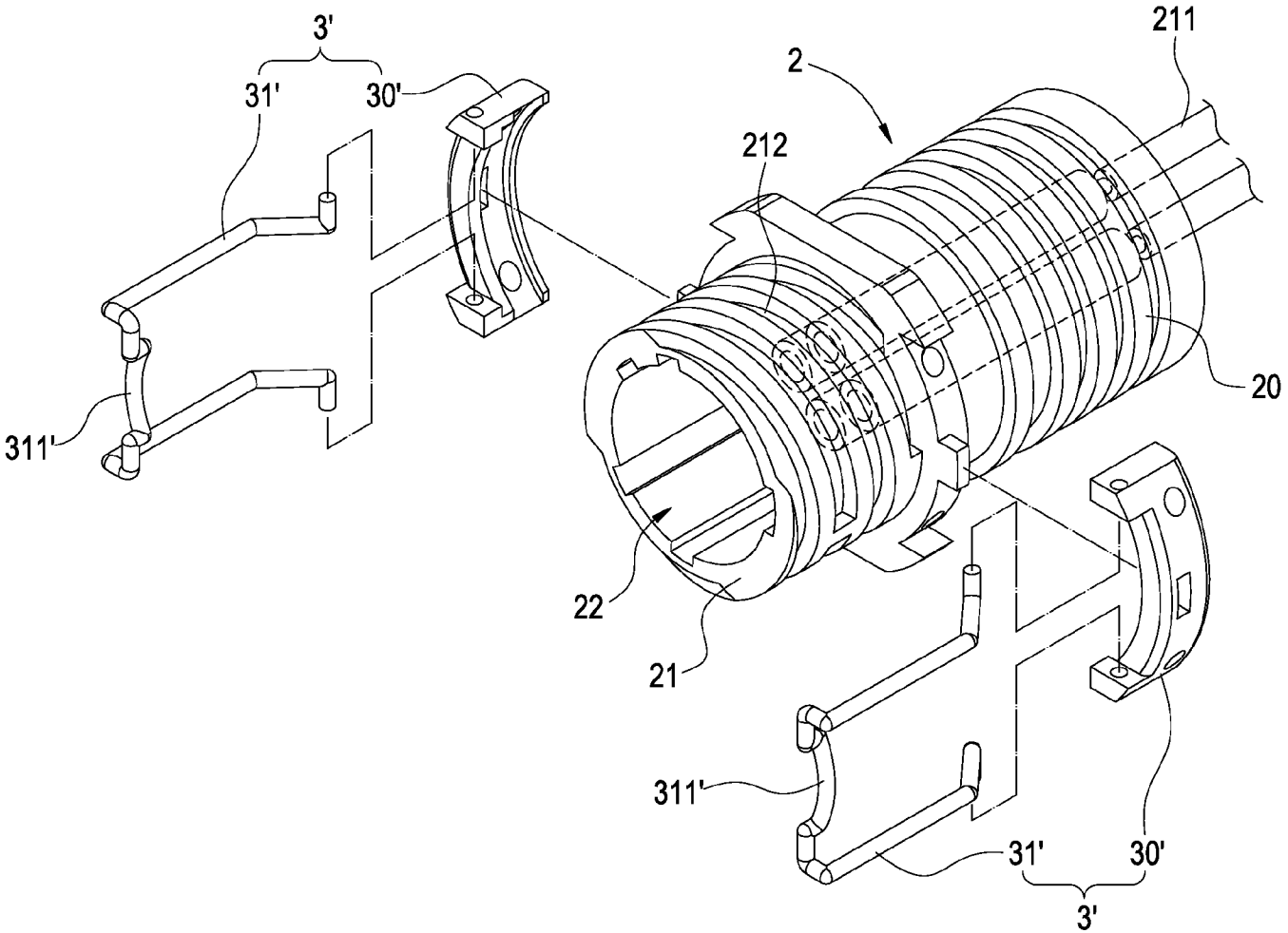
FIG. 7 is an exploded of a female connector in accordance with the second preferred embodiment of the present invention.
Figure 8:
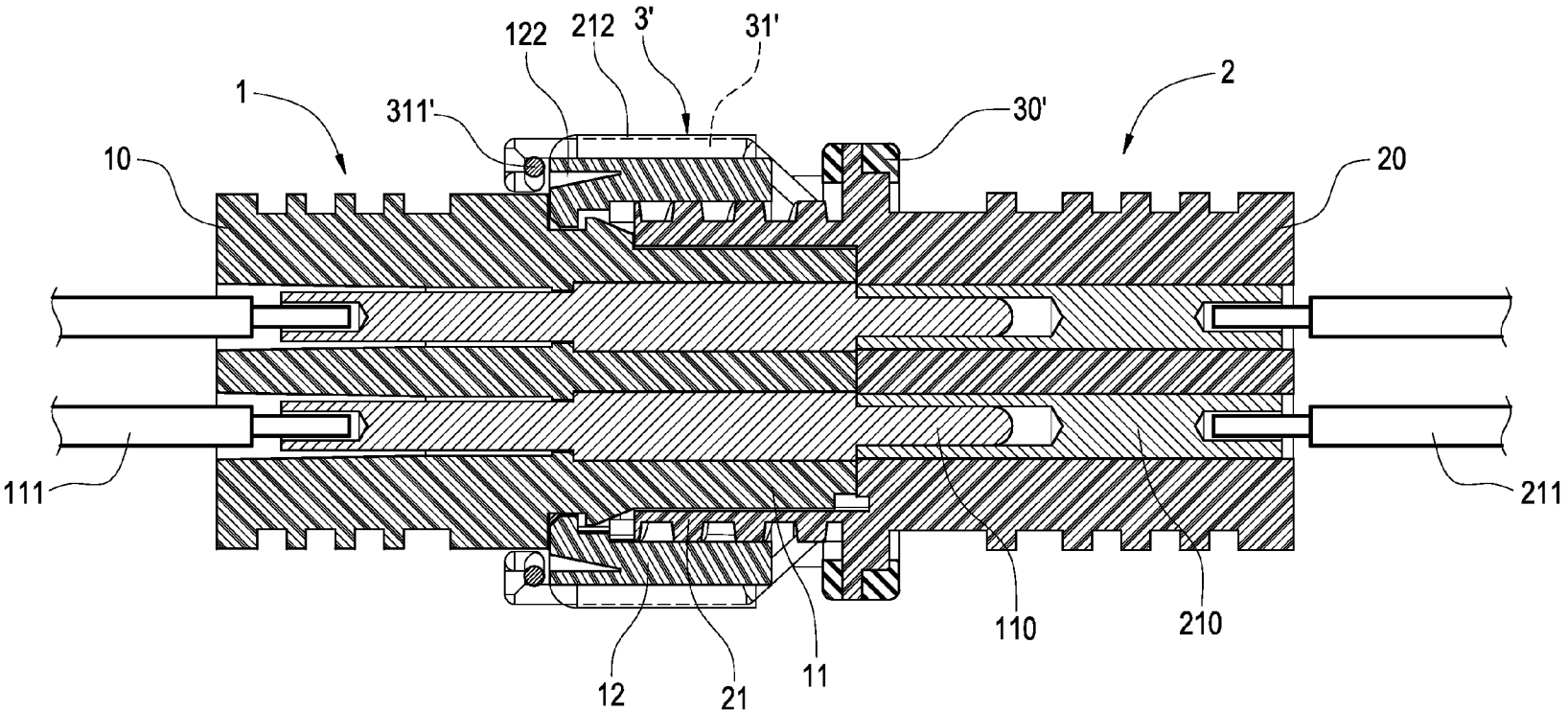
FIG. 8 is a cross-sectional view of the second preferred embodiment of the present invention.

The fastener 3 is provided and separately locked to external sides of the male and female connectors 1, 2 after the male and female connectors 1, 2 are connected. Particularly, the fastener 3 is installed across the screw sleeve 12 of the male connector 1 to limit the rotation of the screw sleeve 12, so as to achieve the effect of preventing the male and female connectors 1, 2 from being loosened. In FIG. 3, the fastener 3 of this preferred embodiment includes a pivot portion 30 formed on an external side of the female connector 2 and a locking arm 31 pivotally installed onto the pivot portion 30, and the locking arm 31 is extended towards the male terminal 10, disposed across the external wall surface of the screw sleeve 12 and locked to the male connector 1. More specifically, the locking arm 31 as shown in FIG. 4 is substantially in form of a rod with an end as a pivot end 310 matched with the pivot portion 30, and a pivot element 300 is passed through the pivot portion 30 and the pivot end 310 and pivotally coupled with one another, and the locking arm 31 has a locking portion 311 formed at another end, and a corresponding circular groove 122 is concavely formed on the screw sleeve 12 for locking into the locking portion 311 of the locking arm 31.

It is noteworthy to point out that if the fasteners 3 come with a plural quantity and the locking arm 31 is installed across the external wall surface of the screw sleeve 12, the effect of limiting the rotation of the screw sleeve 12 between any two adjacent pushing ribs 121 can be improved.

With reference to FIGS. 5 to 8 for the second preferred embodiment of the present invention, the pivot portion 30' of the fastener 3' is installed on an external side of the female connector 2, and the locking arm 31' is substantially n-shaped, and both side ends of the n-shaped locking arm 31' is pivotally coupled to the pivot portion 30', and the top end of the n-shapes locking arm 31' has an elastic pressing portion 311' for elastically locking the male connector 1 or the screw sleeve 12 of the male connector 1, or even the circular groove 122 of the screw sleeve 12.

The aforementioned components can be used for forming the cable connector joint fastening structure of the present invention.

In summation of the above description, the present invention herein enhances the performance than the conventional structure and further complies with the patent application requirements and is duly filed for patent applications. While the invention has been described by means of specific embodiments, numerous modifications and variations could be made thereto by those skilled in the art without departing from the scope and spirit of the invention set forth in the claims.

What is claimed is:

1. A cable connector joint fastening structure, comprising:

a male connector, including a male terminal body, a male terminal joint installed on the male terminal body, and a freely rotating screw sleeve circularly locked onto an external periphery of the male terminal joint;

a female connector, including a female terminal body, a female terminal joint installed on the female terminal body, and an insert space formed in the female terminal joint for inserting the male terminal joint, and the screw sleeve being screwed and coupled to the female terminal joint; and a fastener, including a pivot portion disposed on an external side of the female connector, and a locking arm pivotally installed on the pivot portion and extended towards the male terminal, disposed across the screw sleeve, and locked to the male connector.

2. The cable connector joint fastening structure of claim 1, wherein the screw sleeve includes a plurality of pushing ribs formed on an external wall surface of the screw sleeve.

3. The cable connector joint fastening structure of claim 2, wherein the pushing ribs are arranged in an axial direction and disposed apart from one another on the external wall surface of the screw sleeve.

4. The cable connector joint fastening structure of claim 3, wherein the locking arm is disposed across any two adjacent pushing ribs on the external wall surface of the screw sleeve.

5. The cable connector joint fastening structure of claim 1, wherein the fastener come with a plural quantity.

6. The cable connector joint fastening structure of claim 1, wherein the locking arm is further locked onto the screw sleeve of the male connector.

7. The cable connector joint fastening structure of claim 6, wherein the screw sleeve includes a circular groove concavely formed thereon and locked by the locking arm.

8. The cable connector joint fastening structure of claim 1, wherein the locking arm is substantially in a rod shape, and includes a pivot end formed at an end of the locking arm and matched with the pivot portion, and a locking portion formed at another end of the locking arm and locked onto the male connector.

9. The cable connector joint fastening structure of claim 8, wherein the pivot end and the pivot portion are pivotally coupled by passing a pivot element.

10. The cable connector joint fastening structure of claim 1, wherein the locking arm is substantially n-shaped and both side ends of the n-shaped locking arm are pivotally coupled to the pivot portion, and the top end of the n-shaped locking arm includes an elastic pressing portion elastically locked onto the male connector.

* * * * *